United States Patent [19]

Takeshita et al.

[11] Patent Number: 4,510,231

[45] Date of Patent: Apr. 9, 1985

[54] METHOD FOR MANUFACTURING A MAGNETIC BUBBLE MEMORY

[75] Inventors: Masatoshi Takeshita; Naoki Kodama, both of Hachioji; Ryo Suzuki, Kodaira; Teruaki Takeuchi, Kokubunji; Yutaka Sugita, Tokorozawa, all of Japan

[73] Assignee: Hitachi, Ltd., Tokyo, Japan

[21] Appl. No.: 462,229

[22] Filed: Jan. 31, 1983

[30] Foreign Application Priority Data

Jan. 29, 1982 [JP] Japan ..... 57-11636

[51] Int. Cl.[3] ..... B05D 5/00; H01F 10/06

[52] U.S. Cl. ..... 430/312; 430/314; 430/319

[58] Field of Search ..... 427/38, 39, 130, 131, 427/132; 430/312, 314, 319

[56] References Cited

U.S. PATENT DOCUMENTS 4,098,917 7/1978 Bullock et al. ..... 427/130

*Primary Examiner*—Evan K. Lawrence

*Attorney, Agent, or Firm*—Antonelli, Terry & Wands

[57] ABSTRACT

A conductor pattern and an ion implanting mask are simultaneously formed by photoetching a conductor film through a single photoresist pattern. An area on which a conductor pattern is to be formed is covered with a photoresist, and ions are implanted to a magnetic film using the conductor film portion not convered with the photoresist, to form a magnetic bubble propagation track. The ion implantation mask and the conductor pattern are formed simultaneously through one mask. Accordingly, reduction of accuracy due to an error in mask alignment is prevented and the manufacturing is facilitated.

21 Claims, 13 Drawing Figures

METHOD FOR MANUFACTURING A MAGNETIC BUBBLE MEMORY

BACKGROUND OF THE INVENTION

1. Field of the Invention

The present invention relates to a method for manufacturing a magentic bubble memory.

2. Description of the Prior Art

As is well known, a prior art magnetic bubble memory usually uses permalloy propagation tracks.

As shown in FIG. 1, propagation tracks (permalloy pattern) 1 made of permalloy (iron-nickel alloy) are formed on a magnetic film (not shown) capable of holding magnetic bubbles such as $(YSm\ Lu\ Ca)_3\ (FeGe)_5O_{12}$ with an insulative film being interleaved therebetween, and a magnetic bubble 2 formed in the magnetic garnet film is propagated along the propagation track 1.

A transfer gate, a swap gate and a replicator are constructed by a conductor pattern 5 shown in FIG. 2 which is formed between the magnetic garnet film 3 and the permalloy pattern 1 with insulative films 4 and 6 being interleaved therebetween. By supplying a controlling pulse current to the conductor pattern 5, various functions are attained.

In order for the permalloy device to operate normally, a positional relation between the permalloy pattern 1 and the conductor pattern 5 is very important. Accordingly, it is essential to enhance mask alignment accuracy when those patterns are formed by photolithography.

On the other hand, as memory density and integration density of the magnetic bubble memory increase, a pattern width and a gap (pattern-to-pattern spacing) of the permalloy pattern have become very small. In order to further increase the integration density, it is necessary to reduce the pattern width and the gap to less than 1 micron. It is, however, difficult to form such a fine permalloy pattern by the prior art photolithography and hence it is very difficult to significantly increase the integration density of the permalloy device.

In order to overcome the above-noted difficulty, an ion implanted device (contiguous disk device) has been proposed which is fabricated by implanting $H_2^+$ or $Ne^+$ ions to the magnetic film through a contiguous mask (moniliform mask) formed on the magnetic film to form an ion implanted region 7 and a moniliform non-ion implanted region 8 of contiguous disk shape on the magnetic layer 3 as shown in FIG. 3.

In such a device, the moniliform non-ion implanted region 8 acts as the bubble propagation track and the bubbles are propagated along an outer edge of the contiguous disk patterns 8.

In the ion implanted device, the propagation track can be more readily formed than that of the prior art permalloy device because no gap is included in the contiguous disk patterns 8. Accordingly, it is very advantageous to increase the integration density.

However, the ion implanted device has a disadvantage in that stability of operation of the replicator, the transfer gate and the swap gate is low. Accordingly, a hybrid device in which a propagation track of a minor loop is formed by the ion implantation and a propagation track of a major loop is formed by the permalloy film has been proposed.

As shown in FIG. 4, the hybrid device has the ion implanted region 7, the conductor pattern 5 and the permalloy pattern 1. Accordingly, three steps of mask alignment are needed to form the hybrid device. The prior art permalloy device which has no ion implanted region 7 can be formed through two steps of mask alignment. Thus, the reduction of the manufacturing accuracy and the increase in the number of the manufacturing steps due to the increase of the mask alignment steps are obstacles to be resolved.

SUMMARY OF THE INVENTION

It is an object of the present invention to provide a method for manufacturing a magnetic bubble memory which enables manufacture of a hybrid device with ease and high accuracy.

In order to achieve the above object, in accordance with an aspect of the present invention, an ion implanting mask necessary to form an ion implanted region and a conductor pattern are simultaneously formed through a common mask.

DESCRIPTION OF THE PREFERRED EMBODIMENTS

An Au/Mo dual layer is usually used as a conductor pattern of a hybrid device and a Mo/Si dual layer is usually used as an ion implanting mask. The underlying layers, that is, the Mo layer and the Si layer enhance the adhesion of the Au layer and the Mo layer, respectively, with an insulative film. The conductor pattern and the ion implanting mask may be formed of other materials and also in single layers.

The Au/Mo layer is used as the conductor pattern since Au has less electromigration and Mo underlie enhances the adhesion of Au layer. For the ion implanting mask, a similar effect can be attained when the Au/Mo layer is used instead of the Mo/Si layer. It should be understood that appropriate materials other than those described above may be used as the ion implanting mask and the conductor pattern.

In the hybrid device, the conductor pattern is used only for the area of the bubble generator, the replicator, the transfer gate and the swap gate which are made of the permalloy film and the conductor pattern is not formed on the propagation pattern area which is formed by the ion implantation.

Accordingly, by using the same material for the ion implanting mask and the conductor pattern and carrying out an exposing step and a developing step simultaneously through the single pattern, the ion implanting mask and the conductor pattern can be simultaneously formed and hence the manufacturing steps are simplified and a yield is improved.

EMBODIMENT 1

FIGS. *5a* to *5c* show steps in one embodiment of the present invention.

As shown in FIG. *5a*, an Au/Mo dual layer (3000 Å/2000 Å) 5 is deposited on a magnetic garnet film 3 by a well-known photolithography technique. (The magnetic garnet film 3 is formed on a non-magnetic garnet single-crystal substrate which is not shown because it is not directly pertinent to the present invention.) A photoresist pattern 9 is formed thereon by a well-known exposure-development technique.

Figure 4:
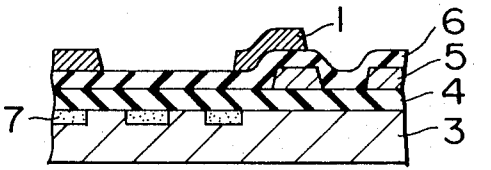
FIGS. 3 and 4 show a plan view and a sectional view of a prior art ion implanted device, and FIGS. *5a–5c* to *7a–7c* show steps of manufacture in accordance with various embodiments of the present invention.
Figure 5A:
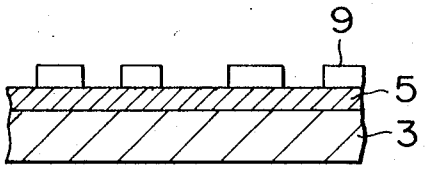
Figure 5B:
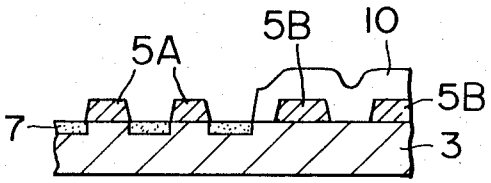

As shown in FIG. 5*b*, exposed areas of the Au/Mo film 5 are removed by ion milling through the photoresist pattern 9 to form an ion implanting mask portion 5A and a conductor pattern portion 5B. An area other than the area in which an ion implanted region is to be formed is covered by a photoresist film 10 having a large ion implantation blocking effect and triple ion implantation by $Ne^+$ (50 KeV, $2\times10^{14}/cm^2$)$-Ne^+$ (180 KeV, $2\times10^{14}/cm^2$) $-H_2^+$ (100 KeV, $4\times10^{16}/cm^2$) is effected to form the ion implanted region 7. Here, it is to be noted that high alignment accuracy is not needed for the implantation mask 10 since bubbles are propagated along the edge of the contiguous disk patterns 8.

Figure 5C:
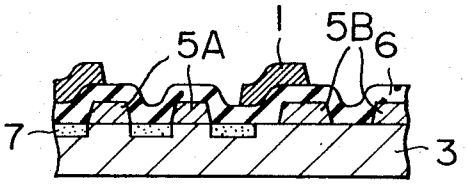
Figure 1:
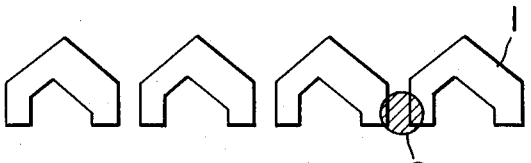
FIGS. 1 and 2 show a plan view and a sectional view of a prior art permalloy device.
Figure 2:
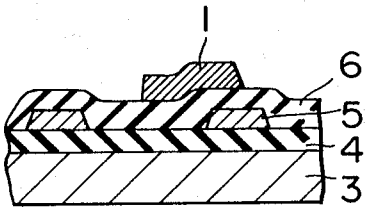
Figure 3:
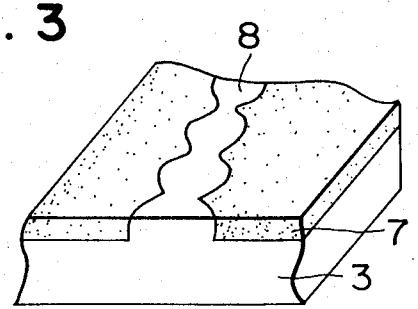

The photoresist film 10 is removed by oxygen plasma and an insulative film 6 is formed by PIQ (trade mark of a polyimide resin available from Hitachi Chemical Industry) as shown in FIG. 5*c*.

A permalloy film is coated on an entire surface and unnecessary portions thereof are removed by a well-known photoetching technique by ion milling to form a permalloy pattern 1 on the insulative film 6.

A $(YSm\ Lu\ Ca)_3\ (Fe\ Ge)_5\ O_{12}$ film having a thickness of 1 micron and a plane orientation of (111) and capable of holding a bubble of approximately 1 micron in diameter was used as the magnetic garnet film 3, and a major line - minor loop hybrid device having a minor loop bit period of 4 μm and a major line bit period of 16 μm was formed by the above method. An operation margin of no less than 10% was attained under a condition of a rotating magnetic field frequency of 200 KHZ and a rotating magnetic field applied in a plane of no less than 40 Oe. It is thus seen that the device manufactured in accordance with the present invention has a sufficient margin.

As seen from FIG. 5*c*, in the present embodiment, the Au/Mo film 5 used as the ion implanting mask, i.e., portion 5A remains unremoved together with the conductor pattern, i.e. portion 5B, but it does not disturb the operation of the device. It should be understood that the Au/Mo film 5 used as the ion implanting mask, i.e., portion 5A may be removed while leaving only the conductor pattern portion 5B. Compared to the conventional method which includes separate deposition, masking and etching steps, the present embodiment reduces the number of manufacturing steps, as well as the improvement in alignment accuracy.

EMBODIMENT 2

Figure 6A:
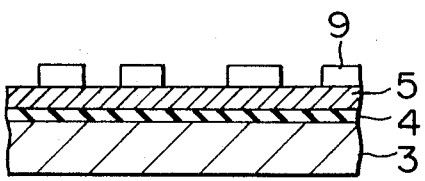

As shown in FIG. 6*a*, an insulative film ($SiO_2$ film) 4 and a conductor film (Au/Mo film) 5 are deposited in stack on a magnetic garnet film 3, and a photoresist pattern 9 for forming an ion implanting mask and a conductor pattern is formed by a well-known method.

Figure 6B:
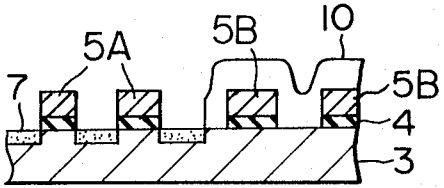
Figure 6C:
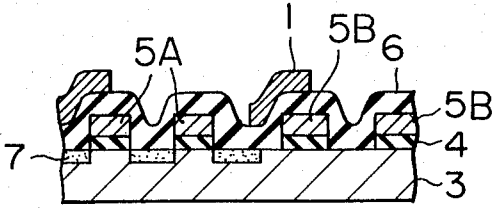

As shown in FIG. 6*b*, exposed areas of the conductor film 5 and the underlying insulative film 4 are removed by ion milling using the photoresist pattern 9 as a mask. The ion implantation, the deposition of the insulative film 6 and the formation of the permalloy pattern 1 are carried out in the same manner as the embodiment 1 to form a device having a sectional structure shown in FIG. 6*c*.

The device formed in the present embodiment also attained an operation margin of no less than 10% at a rotating magnetic field of 40 Oe.

EMBODIMENT 3

Figure 7A:
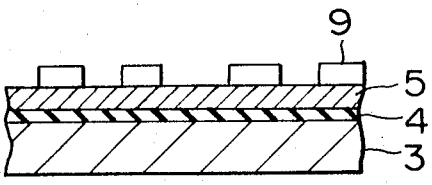

As shown in FIG. 7*a*, a $SiO_2$ film 4 and a conductor (Au/Mo) film 5 are deposited in stack on a magnetic garnet film 3 capable of hoding a magnetic bubble, and a photoresist pattern 9 is formed thereon to form an ion implanting mask and a conductor pattern.

Figure 7B:
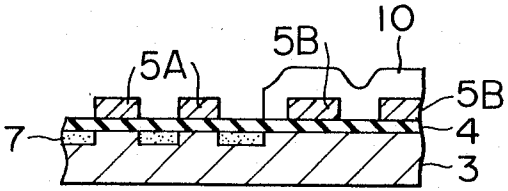

As shown in FIG. 7*b*, exposed areas of the conductor film 5 are removed by ion milling using the photoresist pattern 9 as a mask.

An area other than the area in which ions are to be implanted is covered with a photoresist film 10, and triple ion implantation by $Ne^+$ (150 KeV, $2\times10^{14}/cm^2$) $-Ne^+$ (280 KeV, $2\times10^{14}/cm^2$)$-H_2^+$ (130 KeV, $4\times10^{16}/cm^2$) is effected using the exposed Au/Mo film 5 as a mask to form the ion implanted layer 7.

Figure 7C:
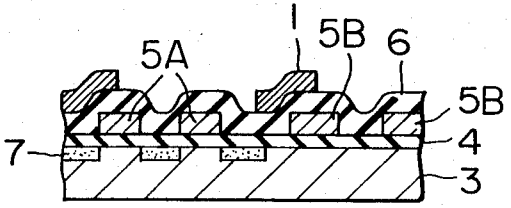

The subsequent steps are same as those in the embodiment 1. Thus, a device having a sectional structure shown in FIG. 7*c* is formed.

The device formed in the present embodiment also attained an operation margin of no less than 10% at a rotating magnetic field of 40 Oe and exhibited an excellent characteristic.

As described above, according to the present invention, the ion implanting mask and the conductor pattern are formed simultaneously through one mask. Accordingly, the present invention is applicable to various types of magnetic film capable of holding the magnetic bubble.

As is well-known, a magnetic garnet film formed by epitaxial growth on a (111) plane of GGG ($Gd_3\ Ga_5\ O_{12}$) has been widely used for the magnetic bubble device. The $(YSm\ Lu\ Ca)_3\ (Fe\ Ge)_5\ O_{12}$ film used in the above embodiments and various magnetic garnet films known as the magnetic bubble device garnet films can also be used.

The Au/Mo dual layer is used as the material of the ion implanting mask and the conductor pattern in the above embodiments. The film used in the present invention is not limited to the Au/Mo dual layer but a Mo/Si dua layer or an Al - Cu alloy single layer, etc. may also be used. The photoresist used to cover the conductor pattern in the ion implantation may be any of well-known resists such as Shipley AZ 1350J (trade name), and either negative or positive resist may be used. Various other materials having a masking effect to the ion implantation, such as polyimide resin, may be used as the mask material as well as the photoresist.

It should be understood that the ions implanted to the magnetic film are not limited to those shown in the above embodiments but various ions which have been heretofore used to form the ion implanted device, such as helium ions and neon ions may be used either singly or in combination under various implantation conditions.

As described hereinabove, according to the present invention, the ion implanting mask and the conductor pattern are simultaneously formed through one photoresist mask. Accordingly, the number of fine photoresist masks required is one less than those of the prior art method. As a result, the photoresist application step and the exposure-development step are saved and an error due to the mask alignment is reduced. Accordingly, the ion implanted propagation track and the conductor pattern can be formed with a high positional accuracy.

The present invention therefore attains the simplification of the manufacturing steps of the composite device and the improvement of the yield and hence offers a significant advantage.

We claim:

1. A method for manufacturing a magnetic bubble memory comprising the steps of:
   (1) depositing a conducting film on a magnetic film capable of holding a magnetic bubble, said conducting film being suitable as a mask against ions to be implanted on said magnetic film;
   (2) forming a photoresist pattern of a desired pattern on said conducting film;
   (3) removing the exposed area of said conducting film form a pattern of conducting film and expose a patterned area of magnetic film;
   (4) removing said photoresist pattern;
   (5) covering a portin of the exposed patterned area of magnetic film and a portion of said pattern of conducting film adjacent said patterned area of magnetic film with a mask film suitable against ions to be implanted in said magnetic film; and
   (6) implanting ions into the uncovered patterned area of said magnetic film to form a magnetic bubble propagation pattern while using the uncovered conducting film pattern as a mask.

2. A method for manufacturing a magnetic bubble memory according to claim 1 wherein the deposition of said conducting film in said step (1) is effected after an insulative film has been deposited on said magnetic film.

3. A method for manufacturing a magnetic bubble memory according to claim 2 wherein the ion implantation in said step (6) is effected on an exposed surface of said insulative film.

4. A method for manufacturing a magnetic bubble memory according to claim 2 wherein the ion implantation in said step (6) is effected through said insulative film.

5. A method for manufacturing a magnetic bubble memory according to claim 1 wherein said conducting film is selected from a group consisting of Au/Mo dual layer, Mo/Si dual layer and Al-Cu alloy layer.

6. A method for manufacturing a magnetic bubble memory according to claim 2 wherein said conducting film is selected from a group consisting of Au/Mo dual layer, Mo/Si dual layer and Al-Cu alloy layer.

7. A method for manufacturing a magnetic bubble memory according to claim 3 wherein said conducting film is selected from a group consisting of Au/Mo dual layer, Mo/Si dual layer and Al-Cu alloy layer.

8. A method for manufacturing a magnetic bubble memory according to claim 4 wherein said conducting film is selected from a group consisting of Au/Mo dual layer, Mo/Si dual layer and Al-Cu alloy layer.

9. A method for manufacturing a magnetic bubble memory according to claim 1 wherein said magnetic film is a a magnetic garnet film.

10. A method for manufacturing a magnetic bubble memory according to claim 2 wherein said magnetic film is a magnetic garnet film.

11. A method for manufacturing a magnetic bubble memory according to claim 3 wherein said magnetic film is a magnetic garnet film.

12. A method for manufacturing a magnetic bubble memory according to claim 4 wherein said magnetic film is a magnetic garnet film.

13. A method for manufacturing a magnetic bubble memory according to claim 9 wherein said magnetic garnet film is formed on a (111) plane of a non-magnetic single crystal substrate.

14. A method for manufacturing a magnetic bubble memory according to claim 10 wherein said magnetic garnet film is formed on a (111) plane of a non-magnetic single crystal substrate.

15. A method for manufacturing a magnetic bubble memory according to claim 11 wherein said magnetic garnet film is formed on a (111) plane of a non-magnetic single crystal substrate.

16. A method for manufacturing a magnetic bubble memory according to claim 12 wherein said magnetic garnet film is formed on a (111) plane of a non-magnetic single crystal substrate.

17. A method for manufacturing a magnetic bubble memory according to claim 5 wherein said magnetic film is a magnetic garnet film.

18. A method for manufacturing a magnetic bubble memory according to claim 6 wherein said magnetic film is a magnetic garnet film.

19. A method for manufacturing a magnetic bubble memory according to claim 7 wherein said magnetic film is a magnetic garnet film.

20. A method for manufacturing a magnetic bubble memory according to claim 8 wherein said magnetic film is a magnetic garnet film.

21. A method for manufacturing a magnetic bubble memory according to claim 17 wherein said magnetic garnet film is formed on a (111) plane of a non-magnetic single crystal substrate.

* * * * *